US008585255B2

(12) United States Patent
Wang

(10) Patent No.: US 8,585,255 B2
(45) Date of Patent: Nov. 19, 2013

(54) LIGHT EMITTING BULB

(75) Inventor: Tsung-I Wang, Taoyuan Hsien (TW)

(73) Assignee: Dynascan Technology Corp., Taoyuan Hsien (TW)

( * ) Notice: Subject to any disclaimer, the term of this patent is extended or adjusted under 35 U.S.C. 154(b) by 0 days.

(21) Appl. No.: 13/538,474

(22) Filed: Jun. 29, 2012

(65) Prior Publication Data

US 2013/0010465 A1 Jan. 10, 2013

(30) Foreign Application Priority Data

Jul. 6, 2011 (TW) ..... 100123900 A
Nov. 16, 2011 (TW) ..... 100141865 A

(51) Int. Cl.
*F21V 7/20* (2006.01)

(52) U.S. Cl.
USPC ..... 362/345; 362/249.02; 362/294

(58) Field of Classification Search
USPC ..... 362/231, 249.02, 294, 345
See application file for complete search history.

(56) References Cited

U.S. PATENT DOCUMENTS 7,965,029 B2 * 6/2011 Tsai ..... 362/294
2011/0075412 A1 * 3/2011 Wu et al. ..... 362/235
2011/0170297 A1 * 7/2011 Hockel ..... 362/294

* cited by examiner

*Primary Examiner* — David V Bruce
(74) *Attorney, Agent, or Firm* — Stites & Harbison PLLC; Juan Carlos A. Marquez, Esq.

(57) ABSTRACT

A light emitting bulb is provided. The light emitting bulb comprises a light source and a cover. The light source is for emitting light. The cover defines an inner space and the light source is disposed inside the cover and heat conductively connected to the cover. The cover is made of heat conductive material and capable of reflecting the light emitted by the light source into the inner space. Therein, a plurality of apertures is formed on the cover to let the light emitted by the light source disposed within the cover emit out from the apertures.

19 Claims, 8 Drawing Sheets

LIGHT EMITTING BULB

BACKGROUND OF THE INVENTION

1. Field of the Invention

The present invention relates to a lamp, and more particularly to a light emitting bulb.

2. Description of the Related Art

Because a light emitting diode (LED) has a light emitting efficiency of more than 150 lm/w, and is mercury free and environment-friendly, the LED has gradually been adopted as a main light source for lighting. However, when the current LED bulb, which utilizes a LED light source, is used as a substitute for a "tungsten filament bulb" or so-called "energy-saving bulb," the following difficulties still exist and arise to challenge the technology thereof:

1. Excessively Small Beam Angle:

A beam angle refers to the effective lighting angle of a bulb within a space. Generally, the beam angle of the "tungsten filament bulb" or so-called "energy-saving bulb" may reach more than 300 degrees. However, currently the beam angle of the LED bulb in the market is about 120 degrees, and rarely goes beyond 180 degrees. One of the reasons why the beam angle of the conventional LED bulb is small is that the LED light emitted pertains to a half-space beam angle, which is similar to a Lambertian light source, and whose beam angle is only 120 degrees (which is calculated with a half-luminance angle thereof, the details of which are described below). It is inferior to the "tungsten filament bulb" or "energy-saving bulb" which has a full-space beam angle. Generally, the light luminance $I_v$ of an ideal Lambertian light source decreases as the beam angle θ between the light luminance $I_v$ and the normal of the LED light emitting plane increases (in which $I_0$ is the maximum luminance obtained when the beam angle θ is 0 degree), with the relation formula thereof:

$$I_v(\theta)=I_0 \cos\theta \quad (1)$$

A schematic view thereof is shown in FIG. 1. It is defined that the available beam angle $\theta_F$ thereof is double the luminance angle $\theta_H$ (at this angle, the luminance $I_v(\theta_H)$ thereof is one half of $I_0$), and it be derived from the formula (1) $\theta_F=2\times\theta_H=2\times60=120$ degrees.

As shown in FIG. 2, another reason why the beam angle of the conventional LED bulb is small is that the shape and structure of the LED bulb limit the beam angle thereof to within 180 degrees. In a general LED bulb, heat sink fins 22 must be fully distributed between the head 21 of a power input end of the bulb and an LED 20 so as to dissipate heat. The materials composing these heat sink fins 22 are mostly metal materials with good heat dissipation ability, such as: aluminum, copper or an alloy thereof, and additionally, nitride aluminum or oxide aluminum ceramic with good heat conduction ability is also utilized. These materials are all opaque materials, however, and thus the LED bulb is restricted to utilizing a light transmissive material for outputting light rays at a front end portion 23 thereof. As a result, the output of the light generated by the light source LED 20 is limited to a maximum of 180 degrees in the front.

Although there currently exists a conventional technology that uses a secondary optical structure in an LED bulb to manufacture an LED bulb with a beam angle of 300 degrees, the structure thereof is complex, the light emitting efficiency is low, and its uniformity is weak. The schematic structure thereof is shown in FIG. 3.

As shown in FIG. 3, the LEDs 31 are distributed around the entire corresponding circumference, the material of the secondary optical structure 30 is a white reflecting body, and a first layer of reflecting plate 32 and a second layer of reflecting plate 33 are disposed inside the conventional LED bulb. As shown in FIG. 3, for the light ray emitted by the LED 31, a part thereof is reflected by the first layer of reflecting plate 32 into bulb holder direction light 34, another part of light ray is reflected by the second layer of reflecting plate 33 into side direction light 35, and additionally, a large part of the light ray is directly emitted through other manners into front direction light 36, thereby forming an LED bulb having a beam angle of 300 degrees. However, the structure thereof is complex, the light emitting efficiency is low, and its uniformity is weak.

2. Non-Uniform Light Emitting:

Because the light flux of 500~1000 μm can be reached only when the power required by the LED bulb is approximately 5 W~10 W, the problems posed by the power and heat conduction of a single-chip LED make it difficult to meet the foregoing requirement. Therefore, LED bulbs generally all use a plurality of chips to meet the foregoing requirement. However, the luminance and chromaticity of these chips are different from each other, leading to non-uniform phenomenon such as light spots or yellow circles on the LED bulb, a problem circumvented by the "tungsten filament bulb", or "energy-saving bulb", whose surface light emission is very uniform.

3. Undesired Light Emitting Inefficiency:

Although the light emitting efficiency of an LED chip can currently reach 150 lm/w, and may further reach 250 lm/w in the future, the overall light emitting efficiency of current bulbs is only approximately 50%~60% of the efficiency of the chip, that is to say, only just 75 lm/w~90 lm/w. The low overall light emitting efficiency of the bulb can be attributed mainly to three factors: (1) electronic circuit efficiency (currently it has reached 80%, and in the future may reach 90%); (2) temperature (the light emitting efficiency of a chip decreases as the temperature increases, and generally whenever the temperature increases by 10° C., the light emitting efficiency thereof decreases approximately by 2%); and (3) low light emitting efficiency of the bulb structure (generally below 80%).

4. Undesired Heat Dissipation Effect:

The structure of the conventional LED bulb is shown in FIG. 2, in which the sum of the area of the heat dissipation region of the heat sink fins 22 and the area of the light emitting region of the front end portion 23 is a constant value. If the heat dissipation region is increased, the area of the light emitting region is decreased; inversely, only when the heat dissipation region is decreased can the light emitting region be increased. Thus, a difficult choice is presented. It is generally decided that the heat dissipation region and the light emitting region each account for approximately 50%. The light emitting region limits the heat dissipation region, and as a result, the heat dissipation effect is hampered, the light emitting efficiency is decreased, and the service life of the LED 20 is shortened. Another problem exists. As shown in FIG. 4, because a lamp shade 41 of a lamp mounted with a conventional LED bulb limits air convection of a heat dissipation region 42 thereof, the heat dissipation becomes excessively deficient. As shown in FIG. 4, a glass lamp shade 41 causes hot air to converge at a part of the heat dissipation region 42 of a conventional LED bulb, rendering it unable to dissipate heat. Although air convection at the light emitting region 43 of the conventional LED bulb is intrinsically good, this air convection is unable to fulfill its role in heat dissipation, which causes the temperature of the LED chip to become very high.

5. Excessively Heavy Weight:

In the conventional LED bulb shown in FIG. 2, the heat sink fins 22 that must be disposed to assist in heat dissipation increase the weight thereof to approximately 150 g, which is excessive compared with the weight of the general "tungsten filament bulb", which is only approximately 50 g.

6. Undesired Appearance:

The light emitting region of the general "tungsten filament bulb" or "energy-saving bulb" is a complete sphere, and the shape thereof is aesthetic and smooth. However, in the conventional LED bulb shown in FIG. 2, a large part of the heat dissipation region is exposed beside the light emitting region thereof. Its strange resultant shape makes the conventional LED a less likely option for general household lighting.

7. Increased Electric Shock Risk Caused by the Metal Heat Dissipation Region:

Conventional LED bulbs have gradually begun to adopt high-voltage direct-current or alternating-current power sources for the LED, but the power supply thereof is directly input after the alternating-current is rectified. If the heat sink fins thereof are made of a metal material, electric shock is easily caused while a ground terminal is inversely inserted. Therefore, an isolation transformer must be utilized to prevent electric shock, which increases power loss and cost.

8. Excessively High Price:

Currently, the price of an LED chip has been reduced to 300~400 lm/USD; that is, the lumen quantity of each dollar has reached 300~400 lm, and in future the price may be reduced to 1000 lm/USD. Although a bulb chip having 1000 lumens currently only requires 2.5~3.3 dollars, because the overall efficiency is only 50%~60% of the light emitting efficiency, the actual cost for using an LED chip still reaches 5~7 dollars. After adding the heat sink fins and the electronic circuit, the unit cost is still more than 10 dollars, a barrier which prevents it from becoming more widely used.

SUMMARY OF THE INVENTION

The technical problem which the present invention intends to solve and the objective of the present invention:

To sum up, the present invention proposes an innovative light emitting bulb structure, having advantages such as uniform light emitting and improved heat dissipation.

The technical means through which the present invention solves the problem:

To solve the problem faced by the conventional technology, the technical means adopted by the present invention provides a light emitting bulb, including a light source and a cover. The light source is used for emitting light. The cover defines an inner space, and the light source is disposed inside the cover and is heat conductively connected to the cover. The cover is made of heat conductive materials and capable of reflecting the light emitted by the light source into the inner space. Therein, a plurality of apertures formed on the cover allows the light emitted by the light source disposed inside the cover to emit out from the apertures.

Specific embodiments adopted by the present invention are further illustrated with reference to the following embodiments and accompanying drawings.

BRIEF DESCRIPTION OF THE DRAWINGS

The invention will be described according to the appended drawings in which.

PREFERRED EMBODIMENT OF THE PRESENT INVENTION

The phrase "more than or below" in reference to a number in this specification includes the number itself. It should be understood that this specification discloses some methods and procedures for performing the disclosed functions, that various structures capable of executing the same function as and relevant to the disclosed structure exist, and that the foregoing structures may generally achieve the same result.

Figure 1:
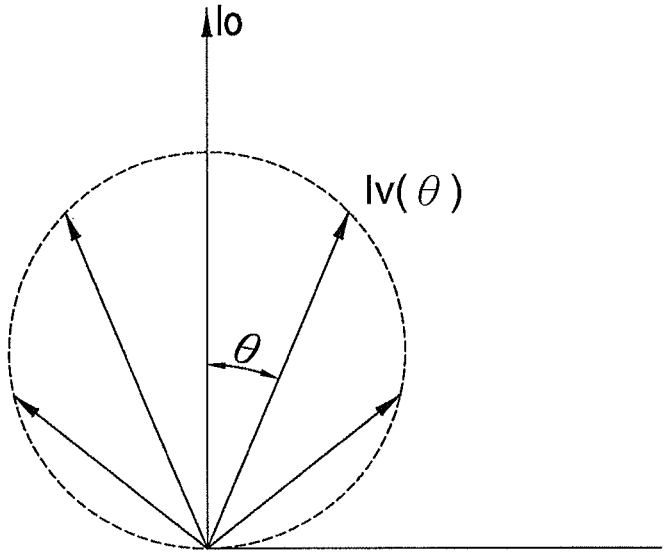
FIG. 1 is a schematic view of an ideal Lambertian light source.
Figure 2:
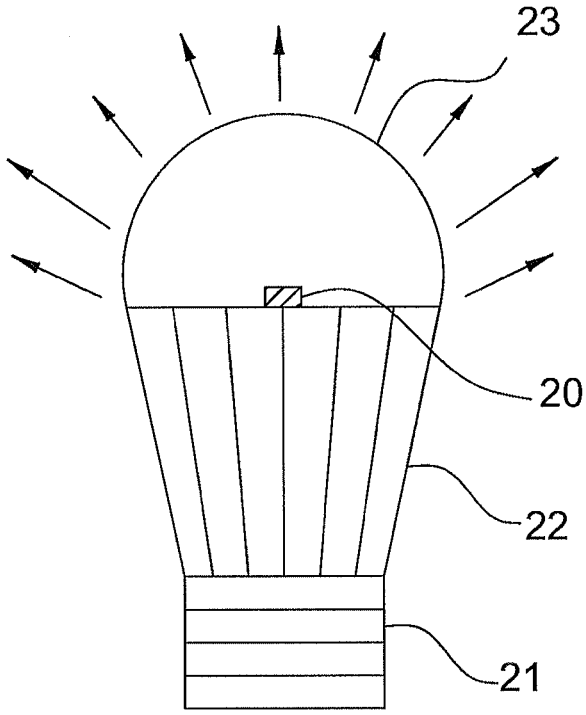
FIG. 2 is a schematic view of a conventional LED bulb.
Figure 3:
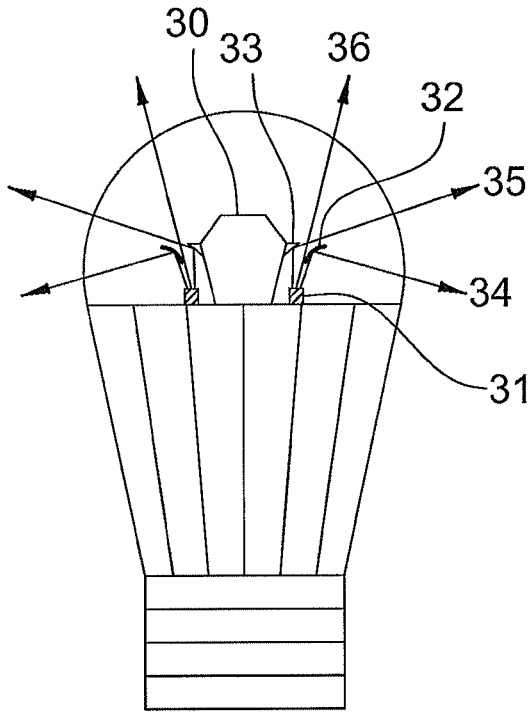
FIG. 3 is a schematic view of another conventional LED bulb having a secondary optical structure.
Figure 4:
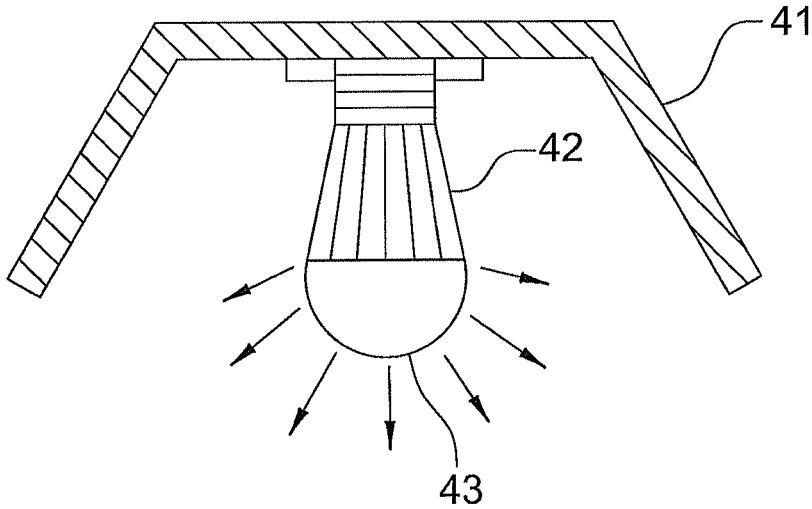
FIG. 4 is a schematic assembly view of a conventional LED bulb.
Figure 5:
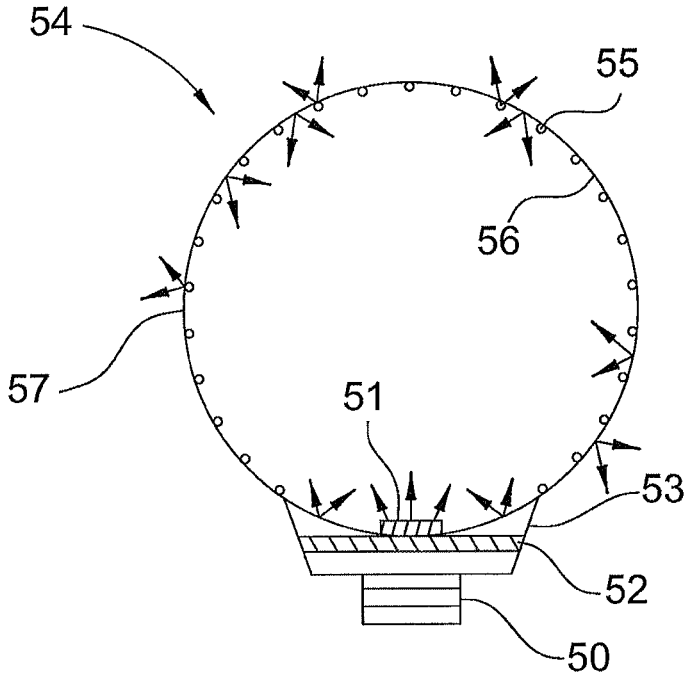
FIG. 5 is a schematic view of a light emitting bulb according to a first preferred embodiment of the present invention.

A structure of an embodiment of the present invention is shown in FIG. 5, in which a light emitting bulb of the present invention includes a bulb power supply input head end 50, a light source, a circuit board 52, a shell 53, and a cover 54 connected to and capable of being combined into one piece with the shell 53.

The light source is used for emitting light, and includes at least one light emitting diode (LED) 51, organic LED (OLED), or other light emitting light source such as a laser. The cover 54 defines an inner space, and the light source is disposed inside the cover 54 and is heat conductively connected to the cover 54. The cover 54 is made of heat conductive material and capable of reflecting the light emitted by the light source into the inner space. Furthermore, a plurality of apertures 55 formed on the cover 54 allows the light emitted by the light source disposed inside the cover 54 to emit out from the apertures 55.

The light source, such as the LED 51, is Mounted onto the circuit board 52, and as long as a good heat conductive connection (including both direct connections and indirect connections) exists between the circuit board 52 and the cover 54, no matter whether the circuit board 52 is disposed inside the cover 54 or outside the cover 54, heat can be dissipated through the air via the cover 54.

Specifically, if the circuit board 52 is disposed inside the cover 54, heat generated by the LED 51 and the circuit board 52 of the light source is directly dissipated through the air via the cover 54. If the circuit board 52 is disposed outside the cover 54 (as shown in the embodiment of FIG. 5), heat generated by the LED 51 of the light source and the circuit board 52 can be directly dissipated through air via the cover 54; alternatively, because the circuit board 52 is mounted into and heat conductively connected to the shell 53, and the shell 53 is heat conductively connected to the cover 54, the heat generated by the LED 51 of the light source can also be conducted to the shell 53 through an aluminum substrate included in the circuit board 52, then conducted to the light emitting bulb cover 54, and finally dissipated through the air.

In some embodiments, if no direct heat conductive connection exists between the circuit board 52 and the cover 54, heat generated by the LED 51 and the circuit board 52 of the light source can also be only conducted to the shell 53 through the aluminum substrate included in the circuit board 52, then conducted to the light emitting bulb cover 54, and finally dissipated through the air.

Additionally, the power supply input head end 50 used for providing power supply input is engaged with the shell 53 of the light emitting bulb, used to provide the lighting driving required by the light source, and also supports the entire bulb.

The cover 54 defines an inner space, and the light source, in this case the LED 51, is disposed inside the cover 54. The light emitting bulb cover 54 can reflect the light emitted by the LED 51. In this embodiment, the cover 54 is substantially a spherical shell shape. The bulb cover 54 is made of heat conductive materials and preferably is made of metal with good heat conductivity, such as aluminum, copper or an alloy thereof. The spherical shell-shaped cover 54 also serves as a light emitting surface of the light emitting bulb, so enormous apertures 55 are arranged on the cover 54 so as to let the light emitted by the light source disposed inside the cover 54 emit out from the apertures 55. The inside of the spherical shell-shaped cover 54 of the light emitting bulb is preferably coated with white reflective coating 56 to reflect (or diffuse) the light emitted by the light source into the inner space. Only a coating with high reflectivity and whiteness should be selected as the white reflective coating 56. Currently, the most commonly used white reflective coatings 56 includes Barium Sulphate ($Ba_2SO_4$), Polytetrafluoroethylene (Teflon) or titanium dioxide ($TiO_2$) with preferable reflecting characteristics, so that the reflectivity thereof may reach 98%, and the whiteness thereof may reach 99%. The reflective coating 56 is a diffusive reflecting material. Therefore, after the light ray is emitted by the LED 51 to the inner wall surface of the spherical shell-shaped cover 54, and passes through the white reflective coating 56, the light ray is diffused almost all the way back into the inner space of the cover 54, greatly minimizing light absorption loss.

In order to improve the aesthetic appearance of the light emitting bulb cover 54 and prevent electric shock, the outside of the spherical shell-shaped cover 54 of the light emitting bulb is coated with a white electric insulation coating 57. Therefore, the entire light emitting bulb cover 54 can present the same uniform white color as that of a conventional energy-saving bulb, and because of the electrical insulation provided by the electric insulation coating 57, the risk of electric shock is also prevented.

The structure of the present invention adopts the optical integrating sphere principle as the starting point. Following the optical integrating sphere principle, it is important to utilize the spherical structure characteristics. Because the light ray is reflected many times inside the spherical shell-shaped cover 54, the light ray is completely uniformed. In other words, if a point light source is disposed at any point on the sphere, the light flux on any unit area on the sphere will be the same as other areas; namely, the light flux of the point light source is evenly distributed onto the entire sphere, so that the light flux of all unit areas thereof is close to the same. If the light diffusive angles at different point sources on the sphere are also the same, light luminance (light flux per unit solid angle) at those point sources are also the same. Because the inside of the cover 54 is coated with the white reflective coating 56 and the diffusion thereof is even and effective, the foregoing condition is satisfied, that is, the light luminance at any point source inside the lamp shell is very uniform. The foregoing theory is illustrated in FIG. 6.

Figure 6:
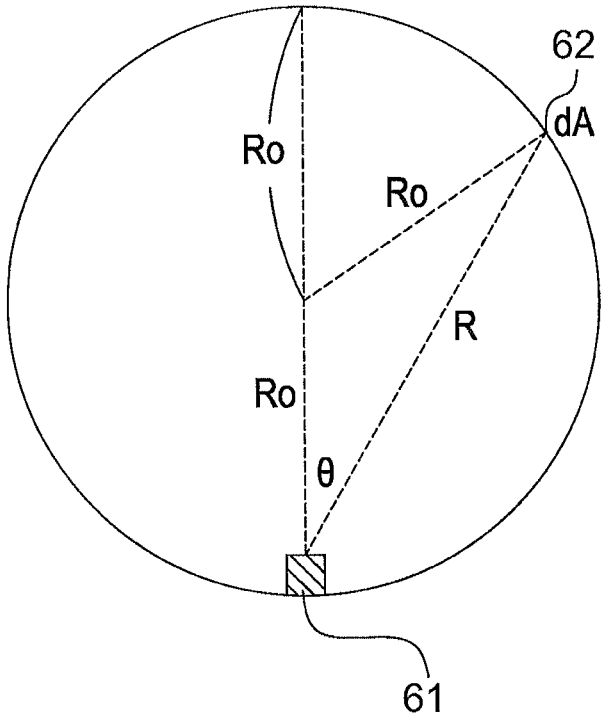
FIG. 6 is a schematic view of the light path of the light emitting bulb according to a first preferred embodiment of the present invention.

An integrating sphere with the radius $R_0$ is shown in FIG. 6, in which the light source LED 61 can be disposed at any point on the sphere of the spherical shell-shaped cover 62, and the light flux of the LED 61 on the area dA at the point position of the spherical shell-shaped cover 62 can be derived by the following mathematical formula.

It is assumed that the LED is a Lambertian point light source, so the light luminance thereof is a function of the angle θ, the magnitude thereof may be assumed to be $I(\theta)=I_0 \cos\theta$, the light flux irradiated by the point light source LED 61 onto the position of the point on the spherical shell-shaped cover 62 is $dL=I(\theta)\,d\Omega$, in which dΩ is a solid angle opened from the LED 61 to the area dA of the position of the point on the spherical shell-shaped cover 62, and R is the distance from the light emitting point 61 to the area dA of the point 62, wherein:

$$d\Omega = \frac{dA\mathrm{Cos}\theta}{R^2}$$

$$\because R = 2R_0\mathrm{Cos}(\theta) \therefore d\Omega = \frac{dA\mathrm{Cos}\theta}{4R_0^2\mathrm{Cos}^2\theta}$$

The foregoing formula is introduced into $dL=I(\theta)\,d\Omega$, and the following can be derived:

$$dL = I(\theta)d\Omega = I_O\mathrm{Cos}\theta\cdot\frac{dA\mathrm{Cos}\theta}{4R_0^2\mathrm{Cos}^2\theta} = \frac{I_O}{4R_O^2} = \frac{I_O}{4R_O^2}dA \tag{2}$$

so the following can be obtained:

$$\frac{dL}{dA} = \frac{I_O}{4R_O^2} \tag{3}$$

It can be known via computation derivation that the light flux on any given unit areas on the sphere is the same. Therefore, if the small area dA is a micro aperture, no matter where the micro aperture is located, the output light flux of light thereof is the same.

Figure 7:
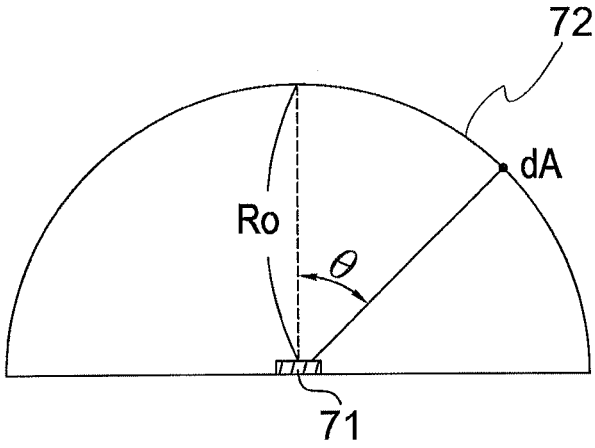
FIG. 7 is a schematic view of the light path of a conventional LED bulb.

However, the structure of a conventional LED bulb, as shown in FIG. 7, an LED 71 is disposed at a center point Ro of a half-sphere of a light emitting bulb cover 72. If the area dA at any point on the sphere is considered, the light flux thereof is:

$$dL = I(\theta)d\Omega = I_O\mathrm{Cos}\theta\cdot\frac{dA}{R_0^2} = \frac{I_O dA}{R_O^2}\mathrm{Cos}\theta$$

so the following can be obtained:

$$\frac{dL}{dA} = \left(\frac{I_O}{R_O^2}\right)\text{Cos}\theta \tag{4}$$

It can be seen from the formula (4) that, the light flux $$\frac{dL}{dA}$$

of a unit area on the sphere changes as the angle θ changes, and the relation therebetween is a Cos θ relation. When θ=60, the light flux $$\frac{dL}{dA}$$

of the unit area on the sphere is reduced to 50%, and generally this angle is called a half-luminance angle $\theta_H$. Double of the half-luminance angle $\theta_H$ is generally referred to as a beam angle $\theta_F=2\theta_H$. It can be known from this description that, the beam angle is 120 degrees. However, it can be seen from the formula (3) that the beam angle of the light emitting bulb of the present invention is independent of the angle θ. Therefore, the beam angle is omnidirectional, that is to say, the beam angle is 360 degrees. It can be seen by comparing the formula (3) and formula (4) that the light emitting bulb of the present invention emits light completely uniformly while the conventional LED bulb emits light non-uniformly.

As shown in FIG. 6, if the point dA is not an aperture, but a shell wall of the cover, the light flux dL is scattered due to the white reflective substance on the shell wall. Because the reflective substance coated on the shell wall is white reflective coating, such as Barium Sulphate ($Ba_2SO_4$), Polytetrafluoroethylene (Teflon) or titanium dioxide ($TiO_2$) etc., and because the reflectivity r of these white reflective bodies within the visible light range is very high, while their Spectra-reflectivity R (λ) thereof is very flat, the light reflected by these white reflective bodies maintains a chromaticity close to the original. That is to say, the whiteness thereof is very high, and generally the whiteness may reach 99%, and the reflectivity r may also reach about 98%. The magnitude of the reflectivity r influences the light emitting efficiency of a bulb. If the reflectivity r is ideally 100%, the light efficiency of the bulb may also reach 100%. However, if the reflectivity r<100%, the light emitting efficiency of the bulb is reduced, and the relation of which is illustrated with reference to FIG. 8.

Figure 8:
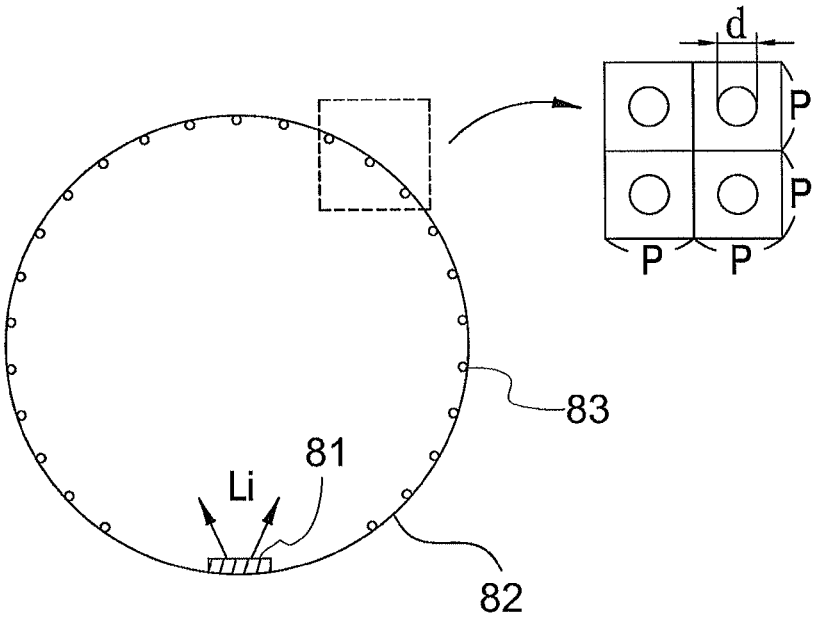
FIG. 8 is a schematic view of the aperture ratio of a cover of a light emitting bulb according to the present invention.

As shown in FIG. 8, it is assumed that an LED 81 is a Lambertian point light source, and the light flux emitted by the LED 81 is Li. A plurality of micro apertures 83 is distributed on a cover 82. If the diameter of a micro aperture 83 is d, and the pitch of the distribution density thereof is P, the aperture opening ratio of all the apertures 83 is defined as:

$$a \cong \frac{(\pi d^2/4)}{P^2}$$

If the apertures 83 formed on the cover of the light emitting bulb are uniformly distributed, after the light flux Li emitted by the light source LED 81 passes through all the apertures 83, the light flux transmitted at the first time can be derived from $L_1$=a*Li, and the light flux remaining after the first time can be derived from $Lr_1$=Li−aLi=(1−a)Li. The remaining light flux after the first time $Lr_1$ is then reflected back into the inner space of the cover 82 through the cover 82. If the reflectivity of the cover 82 is r, the reflected light flux at the first time thereof is r(1−a)Li. This reflected light flux is evenly reflected to the shell wall, and after this reflected light flux passes through all the micro apertures 83, the light flux transmitted after the second time is generated, that is, $L_2$=a*r(1−a)Li. Likewise, the remaining light flux after the second time can be derived from $Lr_2$=r(1−a)Li−ar(1−a)Li=r(1−a)$^2$Li. The remaining light flux after the second time $Lr_2$ is then reflected back into the inner space of the cover 82 through the shell wall, and repeatedly reflected and passed through; the rest may be deduced by analogy, and the total quantity of emitted light L may be obtained from:

$$\begin{aligned} L &= L_1 + L_2 + L_3 + \ldots \\ &= aLi + ar(1-a)Li + ar^2(1-a)^2Li + \ldots \\ &= aLi\left(1 + r(1-a) + r^2(1-a)^2Li \ldots\right) \\ &= \frac{aLi}{1-r(1-a)} \end{aligned}$$

The light emitting efficiency is defined as:

$$\eta = \frac{L}{Li} = \frac{a}{1-r(1-a)} \tag{5}$$

It may be obtained from formula (5) that, the higher the reflectivity r is, the higher the light emitting efficiency η is. For example, if the light emitting bulb cover 82 is designed with an aperture 83 with the diameter d=0.8 mm, and the distribution pitch thereof P=1 mm, the aperture opening ratio thereof is:

$$a = \frac{\pi \cdot 0.8^2}{4.1^2} = 0.5$$

If the reflectivity of the coated white reflective coating r=0.98, from formula (5), the light emitting efficiency thereof is $$\eta \cong \frac{0.5}{1-0.98(1-0.5)} = 0.98$$

That is to say, the effective light emitting efficiency of this light emitting bulb is 98%. It can be seen from this description that the light emitting efficiency of the LED bulb of the present invention is very high. However, if the aperture opening ratio a=0.3, the light emitting efficiency thereof η=95.5%. The smaller the aperture opening ratio a is, the better the overall light blending effect thereof is, but the light emitting efficiency is slightly reduced, so the aperture opening ratio a must be properly selected.

In the light emitting bulb of the present invention, the entire spherical shell-shaped cover is mostly made of highly heat conductive materials, such as aluminum, copper, or alloys thereof, and may also be made of another highly heat conductive material such as the ceramic material of nitride aluminum or oxide aluminum, or made of a composite material thereof. The covers of these light emitting bulbs may be integrally formed or formed individually in a stamping manner. If the apertures are formed on a metal cover, the apertures may be formed in a stamping manner or press casting manner. If the cover is made of ceramic material, the apertures may be formed in a mold sintering manner.

The light emitting efficiency and the service life of an LED mainly depend on the magnitude of the chip junction temperature Tj. Generally, the lower the temperature Tj is, the higher the light emitting efficiency is, and the longer the service life is. The magnitude of the junction temperature depends on such mechanisms as the heat conduction from the LED die to the circuit board, the heat conduction from the circuit board to the shell, and finally, the heat dissipation from the shell through the air. Currently, because the packaging and heat conduction technologies of the high power LED die have been greatly improved, the temperature rise from the die to the circuit board can be controlled within 10° C. The circuit boards currently utilize an aluminum substrate, and the heat conductivity thereof is also very high, so the temperature rise is also very small. Therefore, throughout the entire heat transfer process, the main source or bottleneck of temperature increase is the heat dissipation mechanism from the shell to the air.

As for the LED bulb used for indoor lighting, the heat dissipation mechanism from the cover to the air mainly includes an air convection mechanism and a radiation mechanism. The relation formula of the heat dissipation mechanism of air convection is:

$$P_a = h_a A \Delta T \tag{6}$$

In formula (6), $P_a$ is the convection heat power between the cover and air, $h_a$ is the convection heat dissipation coefficient, A is the effective area of the cover, and ΔT is the temperature difference between the cover and the external air. Generally, the convection heat dissipation coefficient $h_a$ pertains to factors such as the cover structure and the air flow speed. The effective area of the cover, A, pertains to the structure. In order to increase the effective area A, the conventional LED bulb mostly relies on the fin structure, but when the depth of the fin structure is enlarged, the effect is also gradually decreased. However, the most severe case leads to only natural convection occurring in the LED bulb, so the fin structure's effect is rather small.

Additionally, the relation formula of the heat dissipation mechanism of radiation is:

$$P_r = \epsilon\sigma A(T^4 - T_a^{\,T}) \cong 4\epsilon\sigma A T_a^{\,3} \Delta T \tag{7}$$

In formula (7), Pr is the radiation power of the cover, ϵ is the emissivity of the cover material, σ is a Stefan-Boltzman constant=$5.6\times10^{-8}$ $w/m^2k^4$. Therein, Ta is the air temperature, and if Ta is 300 k, formula (7) may be modified as:

$$Pr = \epsilon hr A \Delta T \tag{8}$$

(in which hr≅6.0 $w/m^2$ k)

It can be seen from formula (8) that the cover's emissivity ϵ influences the heat dissipation efficiency of radiation. Generally, the emissivity of a full Black-Body is 1.0, and the emissivity of a fully reflective body is 0. Generally, the emissivity of pure aluminum metal is approximately below 0.1, so the cover needs coatings, such as: Barium Sulphate coating, which can increase the emissivity thereof to about 0.9, giving it superior heat dissipation efficiency of radiation.

However, in a completely windless state, it may be assumed that the air convection coefficient is $h_a \cong 5.0$ $w/m^2k$. By utilizing formulas (6) and (8), the temperature rise of the LED bulb may be estimated. For example, if the diameter of the spherical shell of an LED bulb of 10 W is 10 cm, the temperature rise from the circuit board to the cover is ΔT, and since:

$$P = P_a + P_r = (ha + hr)A\Delta T$$

$$\therefore \Delta T = \frac{P}{(ha + hr)A} = \frac{10\text{ W}}{(6+5)\cdot\pi/4\cdot10^2\cdot10^{-4}} \cong 29^\circ\text{ C.}$$

If the temperature rise from the LED chip junction to the circuit board is 10° C., plus the temperature rise from the circuit board to the cover being 29° C., the LED chip junction temperature would be $T_j$=25° C. (room temperature)+29° C.+10° C.=64° C. Generally, the LED junction temperature is below 85° C., and both the light emitting efficiency and the service life thereof may be maintained at a considerably high level.

However, for a conventional LED bulb, if one half of the area of the spherical shell-shaped cover thereof is used for heat sink fins, and the other half serves as the lighting area, the effective area A thereof halved. Although the heat sink fins of a conventional LED bulb have the effect of increasing the area, in a completely windless state, when air is in natural convection, the function of the fin is very minimal, and as a result, the radiation mechanism is reduced. Therefore, at the same power, the temperature rise thereof may reach about 60° C., the junction temperature thereof $T_j$=25° C.+60° C.+10° C. reaches 95° C., and the light emitting efficiency and the service life thereof are greatly reduced.

In the present invention, for example, as shown in FIG. 5 and FIG. 8, because the entire covers 54 and 82 of the light emitting bulb are used for heat conduction and heat dissipation, the covers 54 and 82 of the light emitting bulb must be good heat conductive bodies. However, a good heat conductive body is generally an opaque body, so enormous apertures 55 and 83 used for emitting light must be disposed on the entire covers 54 and 82. Because these apertures 55 and 83 may cause dust or impurities to enter the lamp shell, the white reflective coating 56 on inside of the LEDs 51 and 81 or the shell may deteriorate, and therefore the outsides of the covers 54 and 82 of the entire light emitting bulb may be covered with a light transmissive layer for protection. The light transmissive layer may be a plastic film or some other transparent silica gel material. The implementation method thereof may be that a layer of transparent film is attached or a thin film is sputtered. A schematic view thereof is shown in FIG. 9.

Figure 9:
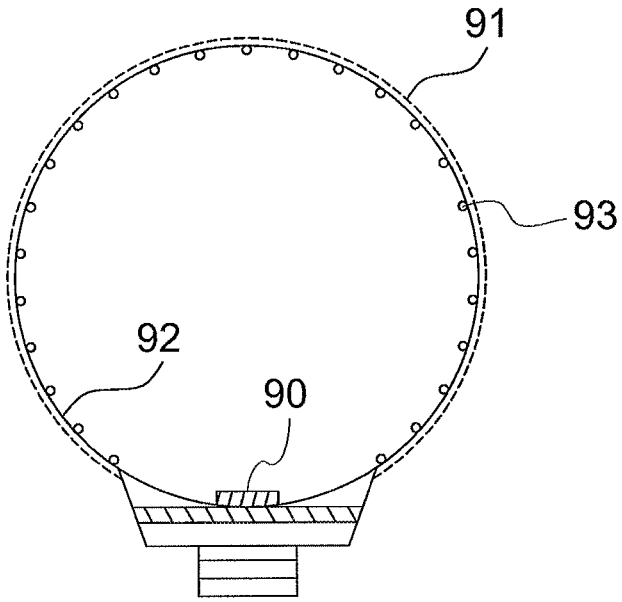
FIG. 9 is a schematic view of a light emitting bulb according to a second preferred embodiment of the present invention.

As shown in FIG. 9, a light transmissive layer 91 covers the outside of the cover 92 to let the light emitted by the light source LED 90 pass through the light transmissive layer 91, then through and out of the apertures 93. The light transmissive layer 91 must be attached close to the outer wall enclosed by the cover 92 to reduce the intermediate air layer and avoid reduction of heat conductive capability. The light transmissive layer 91 may definitely be of a completely clear type or diffuse type. If it is of the diffuse type, materials with good transmittance properties must be selected.

Figure 10:
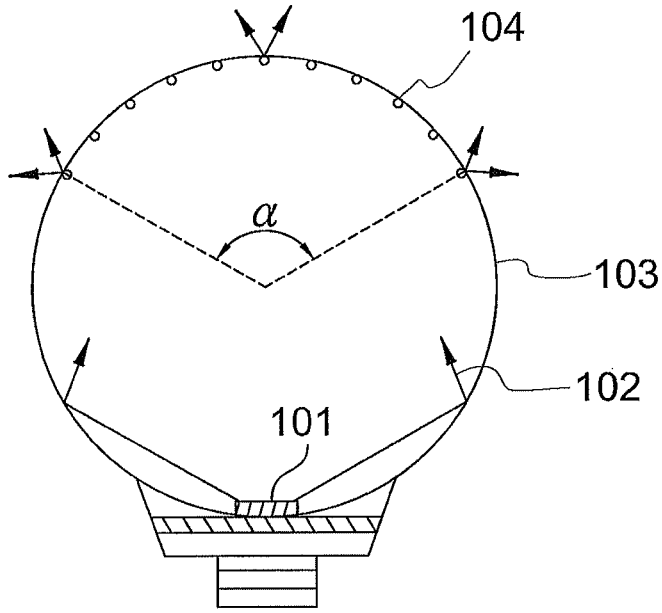
FIG. 10 is a schematic view of a light emitting bulb according to a third preferred embodiment of the present invention.

For the light emitting bulb of the present invention, by controlling the distribution density of the apertures, different "Beam-Angle Distributions" can be obtained. FIG. 10 is another embodiment of the present invention; all apertures 104 used for light emitting are arranged only within the angle α and not arranged within other angles. Therefore, all light flux L of an LED 101 of the light emitting bulb of the present invention is evenly distributed to the solid angle within the output angle α. Because the inside of the spherical shell-shaped cover 103 is coated with white reflective coating with high reflectivity, a light ray 102 emitted by the LED 101 directly hits the white reflective coating on the inside of the spherical shell-shaped cover 103, which has no aperture 104 thereon, and due to the high reflectivity of the coating is diffused back into the inner space of the spherical shell-shaped cover 103, and finally is evenly distributed to the apertures 104 within the output angle α. This angle α may change in size. If the angle α is small, the light angle of the Beam-Angle Distribution of this light emitting bulb is smaller and the light ray of this light emitting bulb is further converged. Therefore, the illuminance at the place directly in front, measured at the same distance, is larger. This type of the light emitting bulb may be used in cases which only require lighting in a small range.

Figure 11:
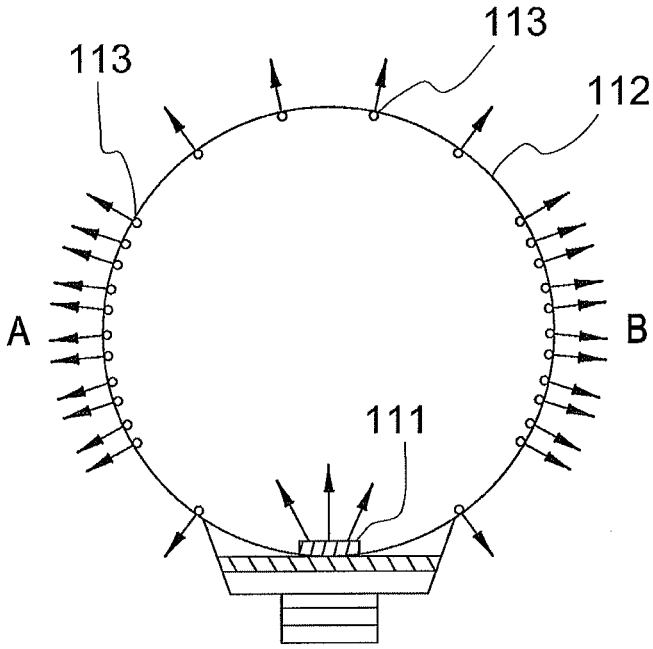
FIG. 11 is a schematic view of a light emitting bulb according to a fourth preferred embodiment of the present invention.

Another embodiment of the present invention is shown in FIG. 11. Apertures 113 formed on a cover 112 of a light emitting bulb are non-uniformly distributed, and the "Beam-Angle Distribution" of the light emitted by an LED 111 of the light emitting bulb is modified by adjusting the distribution density of the apertures 113. The distribution density of the apertures 113 is densest at positions A and B, so the light fluxes of this light emitting bulb are the largest at positions A and B.

Figure 12:
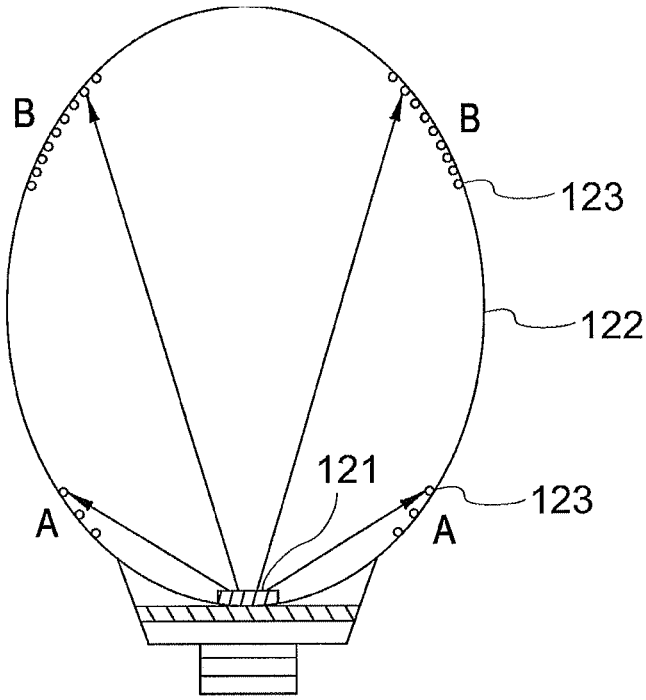
FIG. 12 is a schematic view of a light emitting bulb according to a fifth preferred embodiment of the present invention.

In the above description, the bulb cover in the present invention is illustrated as a spherical shell shape, but in a practical application, the bulb cover may also be of a shape being substantially an ellipsoid or other three-dimensional shapes. According to the foregoing integrating sphere theory, if the cover is a spherical body, light flux distribution at any place on the sphere of a Lambertian point light source is the same. However, if the cover is not of a spherical shell shape, the light flux distribution thereof is varied. As shown in FIG. 12, the cover 122 is substantially of an ellipsoid shell shape, and if the density of apertures 123 is uniform on the cover 122, after the light emitted by the light source LED 121 reaches point A and point B, the light flux of the unit area of point A is larger than the light flux of the unit area of B point. Therefore, if it the intention is to obtain uniform light flux in a unit area, the density of the apertures 123 for light emitting can be adjusted. Taking the embodiment shown in FIG. 12 as an example, the density of the apertures 123 at point B must be larger than the density distribution of the apertures 123 at point A. Therefore, through the adjustment of the density of the apertures 123 in conjunction with the distribution of the light flux on the ellipsoid shell-shaped cover 122, uniform light flux output may be obtained.

Figure 13:
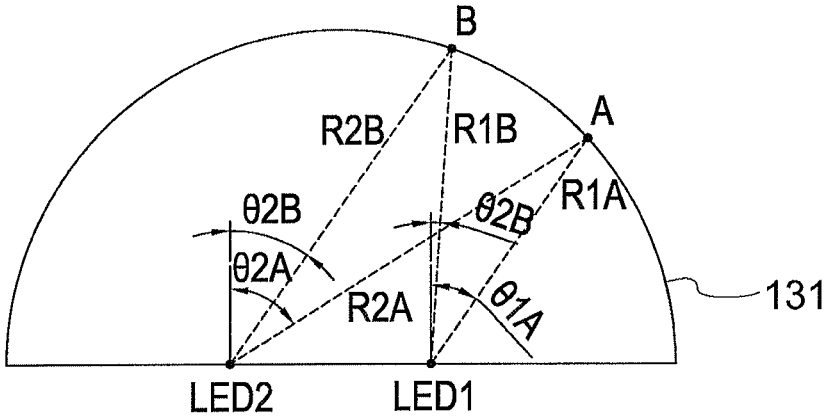
FIG. 13 is a schematic view of the light paths of multiple LEDs of a conventional LED bulb.

As described above, currently, one of problems of the conventional LED bulb is that the light emitting thereof is non-uniform, and the non-uniform light emitting thereof includes non-uniform luminance and non-uniform chromaticity. However, the present invention can overcome this problem to achieve uniform luminance and chromaticity, and the principle thereof is illustrated in the following description. FIG. 13 denotes a structure of the current conventional LED bulb. Therein, LED 1 and LED 2 are two different LED chips, which are disposed at different positions on the diameter of the half-sphere of the cover. Combined luminance and chromaticity of LED 1 and LED 2 of the conventional LED bulb at position A and position B of the light emitting bulb cover 131 may be calculated through the following three stimulus values.

It is assumed that three stimulus values of the light flux of the light emitted by LED 1 are $X_1$, $Y_1$, and $Z_1$, and three stimulus values of the light flux of the lightemitted by LED 2 are $X_2$, $Y_2$, and $Z_2$, and it is assumed that both LED 1 and LED 2 are Lambertian point light sources, and three stimulus values of the light flux of LED 1 on a small area ds at position A of the cover of the light emitting bulb are $dX_{1A}$, $dY_{1A}$, and $dZ_{1A}$, in which:

$$dX_{1A} = X_1 \frac{ds}{R_{1A}^2} \mathrm{Cos}\theta_{1A}$$

$$dY_{1A} = Y_1 \frac{ds}{R_{1A}^2} \mathrm{Cos}\theta_{1A}$$

$$dZ_{1A} = Z_1 \frac{ds}{R_{1A}^2} \mathrm{Cos}\theta_{1A}$$

Likewise, three stimulus values of the light flux of LED 1 on a small area ds at bulb position B are $dX_{1B}$, $dY_{1B}$, and $dZ_{1B}$, in which:

$$dX_{1B} = X_1 \frac{ds}{R_{1B}^2} \mathrm{Cos}\theta_{1B}$$

$$dY_{1B} = Y_1 \frac{ds}{R_{1B}^2} \mathrm{Cos}\theta_{1B}$$

$$dZ_{1B} = Z_1 \frac{ds}{R_{1B}^2} \mathrm{Cos}\theta_{1B}$$

Likewise, three stimulus values of the light flux of LED 2 on a small area ds at bulb position A are $dX_{2A}$, $dY_{2A}$, and $dZ_{2A}$, in which:

$$dX_{2A} = X_2 \frac{ds}{R_{2A}^2} \mathrm{Cos}\theta_{2A}$$

$$dY_{2A} = Y_2 \frac{ds}{R_{2A}^2} \mathrm{Cos}\theta_{2A}$$

$$dZ_{2A} = Z_2 \frac{ds}{R_{2A}^2} \mathrm{Cos}\theta_{2A}$$

Likewise, three stimulus values of the light flux of LED 2 on a small area ds at bulb position B are $dX_{2B}$, $dY_{2B}$, and $dZ_{2B}$, in which:

$$dX_{2B} = X_2 \frac{ds}{R_{2B}^2} \mathrm{Cos}\theta_{2B}$$

$$dY_{2B} = Y_2 \frac{ds}{R_{2B}^2} \mathrm{Cos}\theta_{2B}$$

$$dZ_{2B} = Z_2 \frac{ds}{R_{2B}^2} \mathrm{Cos}\theta_{2B}$$

Therefore, three stimulus values of the combined light flux of LED 1 and LED 2 on a small area ds at position A are:

$$\left.\begin{aligned} dX_A &= dX_{1A} + dX_{2A} = X_1 \frac{ds}{R_{1A}^2} \mathrm{Cos}\theta_{1A} + X_2 \frac{ds}{R_{2A}^2} \mathrm{Cos}\theta_{2A} \\ dY_A &= dY_{1A} + dY_{2A} = Y_1 \frac{ds}{R_{1A}^2} \mathrm{Cos}\theta_{1A} + Y_2 \frac{ds}{R_{2A}^2} \mathrm{Cos}\theta_{2A} \\ dZ_A &= dZ_{1A} + dZ_{2A} = Z_1 \frac{ds}{R_{1A}^2} \mathrm{Cos}\theta_{1A} + Z_2 \frac{ds}{R_{2A}^2} \mathrm{Cos}\theta_{2A} \end{aligned}\right\} \quad (9)$$

Likewise, three stimulus values of the combined light flux of LED 1 and LED 2 on a small area ds at position B are:

$$\left.\begin{aligned} dX_B &= dX_{1B} + dX_{2B} = X_1\frac{ds}{R_{1B}^2}\mathrm{Cos}\theta_{1B} + X_2\frac{ds}{R_{2B}^2}\mathrm{Cos}\theta_{2B} \\ dY_B &= dY_{1B} + dY_{2B} = Y_1\frac{ds}{R_{1B}^2}\mathrm{Cos}\theta_{1B} + Y_2\frac{ds}{R_{2B}^2}\mathrm{Cos}\theta_{2B} \\ dZ_B &= dZ_{1B} + dZ_{2B} = Z_1\frac{ds}{R_{1B}^2}\mathrm{Cos}\theta_{1B} + Z_2\frac{ds}{R_{2B}^2}\mathrm{Cos}\theta_{2B} \end{aligned}\right\} \quad (10)$$

By utilizing the chromaticity definition specified by CIE1939, chromaticity coordinates (x,y) at position A and position B respectively are:

$$x_A = \frac{dX_A}{dX_A + dY_A + dZ_A},\ y_A = \frac{dY_A}{dX_A + dY_A + dZ_A}$$

$$x_B = \frac{dX_B}{dX_B + dY_B + dZ_B},\ y_B = \frac{dY_B}{dX_B + dY_B + dZ_B}.$$

Because of changes to four parameters $$\frac{\cos\theta_{1A}}{R_{1A}^2},\ \frac{\cos\theta_{2A}}{R_{2A}^2},\ \frac{\cos\theta_{1B}}{R_{1B}^2},\ \text{and}\ \frac{\cos\theta_{2B}}{R_{2B}^2},$$

Figure 14:
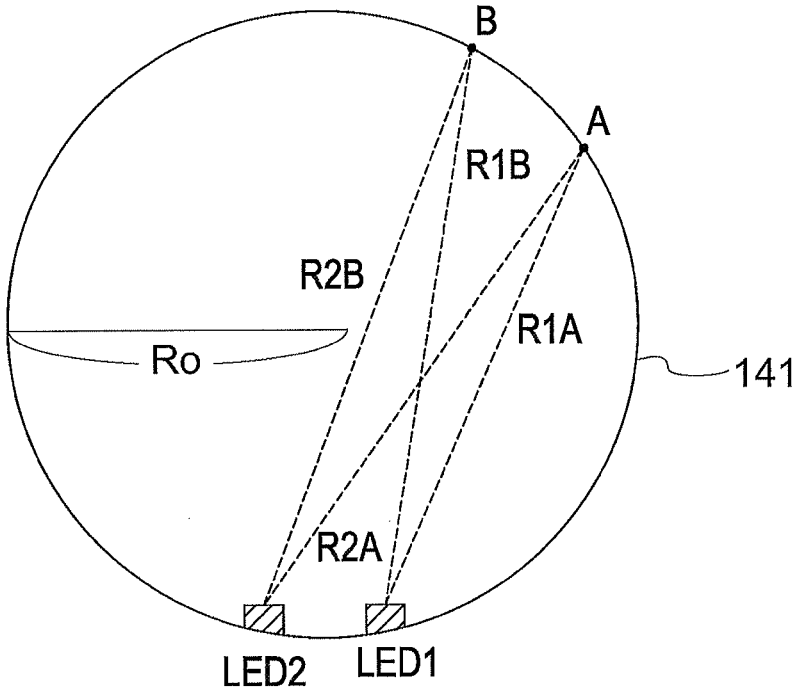
FIG. 14 is a schematic view of a light emitting bulb with multiple LEDs according to a sixth preferred embodiment of the present invention.

$x_A \neq x_B$, and $y_A \neq y_B$. Unless $X_1=kX_2$, $Y_1=kY_2$, and $Z_1=kZ_2$ (k is a ratio), $x_A=x_B$, and $y_A=y_B$ may be obtained. That is, when the chromaticity of LED 1 is the same as that of LED 2, their mixed chromaticity at different positions is also the same. However, it can be seen from formula (9) and formula (10) that $dY_A$ and $dY_B$ are still unequal. That is to say, uniform luminance cannot be obtained. However, it is difficult for different LEDs to be controlled in the same chromaticity; equal chromaticity can only be obtained through categorization, and the price of categorized LED chips is very expensive. However, the light emitting bulb of the present invention can solve the above problem, as described in the following:

As shown in FIG. 14, the light source of the light emitting bulb of the present invention includes a plurality of LEDs 1 and LEDs 2. It is assumed that the radius of a spherical shell-shaped cover 141 of the light emitting bulb is $R_0$, and LED 1 and LED 2 are disposed at different positions of the spherical shell-shaped cover 141. If it is assumed that three stimulus values of the light flux of the light emitted by LED 1 are $X_1$, $Y_1$, and $Z_1$, and three stimulus values of the light flux of the light emitted by LED 2 are $X_2$, $Y_2$, and $Z_2$, and it is assumed that LED 1 and LED 2 are Lambertian light sources, it can be known through derivation from the principle of above formula (2) that three stimulus values $dX_{1A}$, $dY_{1A}$, and $dZ_{1A}$ of the light flux of LED 1 on a small area ds at bulb position A are:

$$dX_{1A} = X_1\frac{ds}{4R_0^2}$$

$$dY_{1A} = Y_1\frac{ds}{4R_0^2}$$

$$dZ_{1A} = Z_1\frac{ds}{4R_0^2}$$

Likewise, three stimulus values $dX_{1B}$, $dY_{1B}$, and $dZ_{1B}$ of the light flux of LED 1 on a small area ds at bulb position B are:

$$dX_{1B} = X_1\frac{ds}{4R_0^2}$$

$$dY_{1B} = Y_1\frac{ds}{4R_0^2}$$

$$dZ_{1B} = Z_1\frac{ds}{4R_0^2}$$

Likewise, three stimulus values $dX_{2A}$, $dY_{2A}$, and $dZ_{2A}$ of the light flux of LED 2 on a small area ds at position A are:

$$dX_{2A} = X_2\frac{ds}{4R_0^2}$$

$$dY_{2A} = Y_2\frac{ds}{4R_0^2}$$

$$dZ_{2A} = Z_2\frac{ds}{4R_0^2}$$

Three stimulus values $dX_{2B}$, $dY_{2B}$, and $dZ_{2B}$ of the light flux of LED 2 on a small area ds at position B are:

$$dX_{2B} = X_2\frac{ds}{4R_0^2}$$

$$dY_{2B} = Y_2\frac{ds}{4R_0^2}$$

$$dZ_{2B} = Z_2\frac{ds}{4R_0^2}$$

Therefore, three stimulus values $dX_A$, $dY_A$, and $dZ_A$ of the combined light flux of LED 1 and LED 2 at position A are:

$$\left.\begin{aligned} dX_A &= dX_{1A} + dX_{2A} = (X_1 + X_2)\frac{ds}{4R_0^2} \\ dY_A &= dY_{1A} + dY_{2A} = (Y_1 + Y_2)\frac{ds}{4R_0^2} \\ dZ_A &= dZ_{1A} + dZ_{2A} = (Z_1 + Z_2)\frac{ds}{4R_0^2} \end{aligned}\right\} \quad (11)$$

Likewise, three stimulus values $dX_B$, $dY_B$, and $dZ_B$ of the combined light flux of LED 1 and LED 2 at position B are:

$$\left.\begin{aligned} dX_B &= dX_{1B} + dX_{2B} = (X_1 + X_2)\frac{ds}{4R_0^2} \\ dY_B &= dY_{1B} + dY_{2B} = (Y_1 + Y_2)\frac{ds}{4R_0^2} \\ dZ_B &= dZ_{1B} + dZ_{2B} = (Z_1 + Z_2)\frac{ds}{4R_0^2} \end{aligned}\right\} \quad (12)$$

Therefore, it can be seen from formula (11) and formula (12) that $dX_A=dX_B$, $dY_A=dY_B$, and $dZ_A=dZ_B$. Therefore, luminance and chromaticity at point A are the same as those at point B. Because point A and point B are considered above to represent any point, any given points on the entire spherical shell will have the same luminance and chromaticity.

By utilizing the chromaticity coordinate principle, a chromatic coordinate (x,y) of any point on the spherical shell may be obtained from formula (11) as:

$$\left.\begin{aligned} x &= \frac{dX_A}{dX_A + dY_A + dZ_A} = \frac{(X_1 + X_2)}{(X_1 + X_2) + (Y_1 + Y_2) + (Z_1 + Z_2)} \\ y &= \frac{dY_A}{dX_A + dY_A + dZ_A} = \frac{(Y_1 + Y_2)}{(X_1 + X_2) + (Y_1 + Y_2) + (Z_1 + Z_2)} \end{aligned}\right\} \quad (13)$$

It can be seen from formula (13) that if the original chromatic coordinate of LED 1 is different from that of LED 2, the chromatic coordinate of any point on the spherical shell thereof is a result of color mixing.

Figure 15:
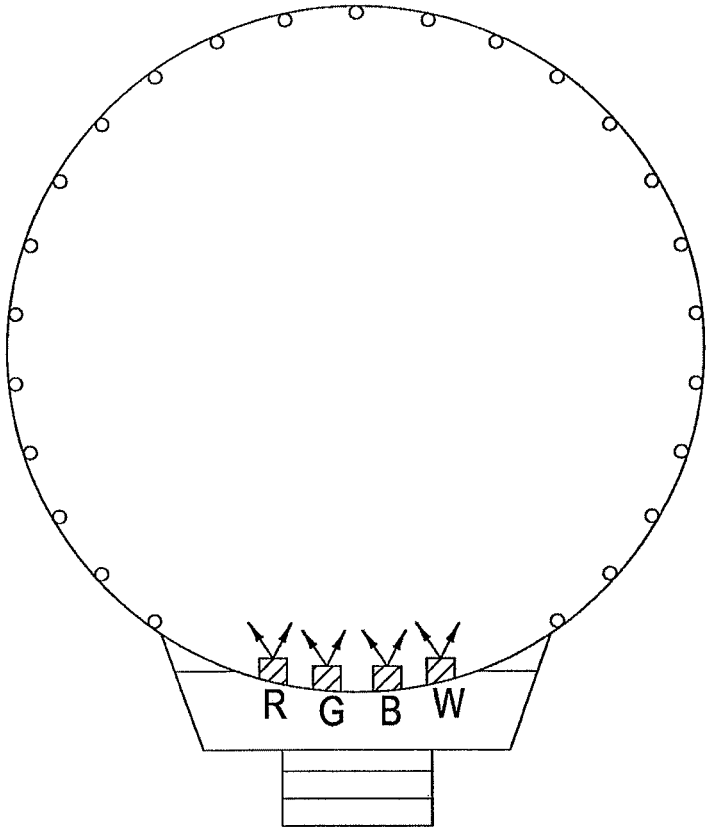
FIG. 15 is a schematic view of a light emitting bulb with LEDs of multiple colors according to a seventh preferred embodiment of the present invention.

With the structure of the present invention, LEDs of different colors may be utilized to obtain the required chromaticity through mixing, and the chromaticity and the luminance of any point on the sphere inside the spherical shell-shaped cover can retain uniformity. Therefore, another embodiment of the present invention is shown in FIG. 15, in which the light source of the light emitting bulb may include a white light LED W or LEDs of different colors. For example, it may include a combination including at least a red light LED R, a green light LED G, and a blue light LED B. By utilizing an LED combination of LEDs of different colors, different color temperatures of the bulb may be adjusted. Further, the structure of the present invention does not generate non-uniform color mixing or non-uniform luminance due to chromaticity and luminance of the LED being different or the positions being different, that is to say, chromaticity and luminance of any point on the lamp shell may be regarded as a result obtained after these of all LEDs are highly mixed.

To sum up, the present invention provides an innovative light emitting bulb, which improves the many foregoing disadvantages of the prior art. In addition to uniform light emission and good heat dissipation, the light emitting bulb of the present invention further has multiple other advantages. As for the eight foregoing disadvantages of the prior art, the light emitting bulb of the present invention improves upon the prior art by achieving the following advantages:

1. The beam angle of the light emitting bulb of the present invention may reach more than 300 degrees, which is almost equal to that of the current "tungsten filament bulb" or "energy-saving bulb."

2. The light emitting uniformity of the light emitting bulb of the present invention is good, and is almost the same as that of the "energy-saving bulb."

3. The light emitting efficiency of the light emitting bulb of the present invention may reach 95%, and the overall efficiency may be increased from about 60%, i.e. the efficiency of current conventional LED bulbs, to about 85%.

4. The heat dissipation effect of the light emitting bulb of the present invention is approximately double that of the conventional LED bulb structure, so the temperature increase may be reduced by half, thereby increasing the efficiency and the service life.

5. The overall weight of the light emitting bulb of the present invention may be approximately equivalent to that of the general "tungsten filament bulb."

6. The appearance of the light emitting bulb of the present invention may be similar to that of the general "tungsten filament bulb," the sphere of the entire spherical shell-shaped cover emits light uniformly, and no light emitting dead angle exists. When the power is not turned on, the appearance may a frosted pure white color, and thus is very aesthetic.

7. The cover of the light emitting bulb of the present invention can comprise electric insulation, so that no electric shock risk exists. It is unnecessary to use an isolation transformer, in contrast to conventional LED bulbs, and thus the electronic loss is reduced and the electronic circuit conversion efficiency is increased.

8. Because the structure of the light emitting bulb of the present invention is simple, the light emitting efficiency is increased, the heat conductive effect is good, the cost of the electronic circuit may be reduced, and thus the total cost may be reduced even further.

Additionally, the light emitting bulb of the present invention may further obtain the following extra advantages:

1. The light emitting bulb of the present invention can achieve different Beam-Angle Distributions by controlling the distribution density and range of enormous light emitting apertures on the spherical shell-shaped cover, such as light emitting in a single direction at a small angle of a "downlight." Therefore, by utilizing the structure of the light emitting bulb of the present invention, a bulb with different applications may be manufactured.

2. The entire cover of the light emitting bulb of the present invention may be a metal structure, and thus the degree of falling-durability thereof is higher.

Through the detailed description discloses the above preferred specific embodiments, its intention is more to describe the features and the spirit of the present invention, and not to limit the scope of the present invention to the foregoing disclosed preferred specific embodiments. Instead, it is intended to encompass various modifications and equivalent arrangements in the scope of claims of the present invention. Therefore, the scope of claims of the present invention should be interpreted in its broadest sense according to the foregoing illustration to enable the scope to encompass all possible modifications and equivalent arrangements.

What is claimed is:

1. A light emitting bulb, comprising:

a light source for emitting light; and a cover defining an inner space, wherein the light source is disposed inside the cover and is heat conductively connected to the cover, and the cover is made of heat conductive material and reflects the light emitted by the light source into the inner space;

wherein a plurality of apertures is formed on the cover, to let the light emitted by the light source disposed inside the cover emit out from the apertures.

2. The light emitting bulb according to claim 1, wherein the light source comprises at least one light emitting diode (LED).

3. The light emitting bulb according to claim 1, wherein the cover is made of aluminum, copper or an alloy material thereof.

4. The light emitting bulb according to claim 1, wherein the cover of the light emitting bulb is made of ceramic material.

5. The light emitting bulb according to claim 1, wherein an inside of the cover of the light emitting bulb is coated with reflective coating.

6. The light emitting bulb according to claim 1, wherein an outside of the cover of the light emitting bulb is coated with electric insulation coating.

7. The light emitting bulb according to claim 1, wherein the apertures formed on the cover of the light emitting bulb are uniformly distributed.

8. The light emitting bulb according to claim 1, wherein the apertures formed on the cover of the light emitting bulb are non-uniformly distributed.

9. The light emitting bulb according to claim 1, wherein the cover of the light emitting bulb is substantially of a spherical shell shape.

10. The light emitting bulb according to claim 1, wherein the cover of the light emitting bulb is substantially of an ellipsoid shell shape.

11. The light emitting bulb according to claim 1, wherein an outside of the cover of the light emitting bulb is covered with a light transmissive layer.

12. The light emitting bulb according to claim 2, wherein the light source comprises a plurality of LEDs.

13. The light emitting bulb according to claim 2, wherein the light source of the light emitting bulb comprises a white light LED or a combination comprising at least a red light LED, and a green light LED, and a blue light LED.

14. The light emitting bulb according to claim 1, wherein the light emitting bulb comprises a circuit board, the light source is mounted onto the circuit board, and the circuit board is heat conductively connected to the cover.

15. The light emitting bulb according to claim 14, wherein the light emitting bulb further comprises a shell, the circuit board is mounted in the shell and is heat conductively connected to the shell, and the shell is heat conductively connected to the cover.

16. The light emitting bulb according to claim 15, wherein the shell and the cover are combined into one piece.

17. The light emitting bulb according to claim 15, wherein the circuit board comprises an aluminum substrate.

18. The light emitting bulb according to claim 5, wherein the reflective coating comprises Barium Sulphate ($Ba_2SO_4$), Polytetrafluoroethylene (Teflon) or titanium dioxide ($TiO_2$).

19. The light emitting bulb according to claim 1, wherein the light source comprises at least one organic LED (OLED).

* * * * *